US011429053B2

(12) United States Patent
Izawa et al.

(10) Patent No.: US 11,429,053 B2
(45) Date of Patent: Aug. 30, 2022

(54) IMAGING SYSTEM WITH TONER LEVELING AND GLOSSING DEVICE

(71) Applicant: Hewlett-Packard Development Company, L.P., Spring, TX (US)

(72) Inventors: Tatsunori Izawa, Yokohama (JP); Takayuki Horie, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/299,079

(22) PCT Filed: Jul. 8, 2020

(86) PCT No.: PCT/US2020/041161
§ 371 (c)(1),
(2) Date: Jun. 2, 2021

(87) PCT Pub. No.: WO2021/007298
PCT Pub. Date: Jan. 14, 2021

(65) Prior Publication Data

US 2022/0121147 A1 Apr. 21, 2022

(30) Foreign Application Priority Data

Jul. 8, 2019 (JP) ..... JP2019-126749

(51) Int. Cl.
*G03G 15/00* (2006.01)
*G03G 15/01* (2006.01)
*G03G 15/08* (2006.01)

(52) U.S. Cl.
CPC ..... *G03G 15/6585* (2013.01); *G03G 15/0194* (2013.01); *G03G 15/0812* (2013.01); *G03G 15/5029* (2013.01); *G03G 2215/0081* (2013.01); *G03G 2215/0805* (2013.01)

(58) Field of Classification Search
CPC ..... G03G 15/6585; G03G 15/0194; G03G 2215/0081; G03G 2215/0805; G03G 15/0812; G03G 15/5029
See application file for complete search history.

(56) References Cited

U.S. PATENT DOCUMENTS

| | | | | |
|---|---|---|---|---|
| 5,004,891 | A | 4/1991 | Landis | |
| 6,535,712 | B2 | 3/2003 | Richards | |
| 8,503,919 | B2 | 8/2013 | Sone et al. | |
| 2011/0206429 | A1* | 8/2011 | Terao | G03G 15/08 399/341 |

FOREIGN PATENT DOCUMENTS

| | | | | |
|---|---|---|---|---|
| CN | 103246180 A | * | 8/2013 | B05C 11/00 |
| JP | 2005266079 A | | 9/2005 | |
| JP | 2011048148 A | | 3/2011 | |

(Continued)

*Primary Examiner* — Walter L Lindsay, Jr.
*Assistant Examiner* — Laura Roth
(74) *Attorney, Agent, or Firm* — Trop Pruner & Hu, P.C.

(57) ABSTRACT

An imaging system includes a toner transfer device, a leveling device and a glossing device. The toner transfer device transfers gloss toner to a surface of a medium. The leveling device levels a layer of the gloss toner on the surface of the medium. The glossing device performs a re-melting process and a cooling process on the medium after the layer of the gloss toner has been leveled.

20 Claims, 23 Drawing Sheets

(56) References Cited

FOREIGN PATENT DOCUMENTS

| | | |
|---|---|---|
| JP | 2013065210 | 4/2013 |
| JP | 2013205463 | 10/2013 |
| JP | 2014048357 | 3/2014 |
| JP | 2014134274 A | 7/2014 |
| JP | 2014134724 | 7/2014 |

* cited by examiner

IMAGING SYSTEM WITH TONER LEVELING AND GLOSSING DEVICE

BACKGROUND

Some image forming systems perform gloss processing on images. In such an image forming system, toner fixed to a medium is heated and pressed to be re-melted and is cooled while being in close contact with a smooth belt surface to smoothen the toner surface.

DETAILED DESCRIPTION

In the following description, with reference to the drawings, the same reference numbers are assigned to the same components or to similar components having the same function, and overlapping description is omitted.

Figure 1:
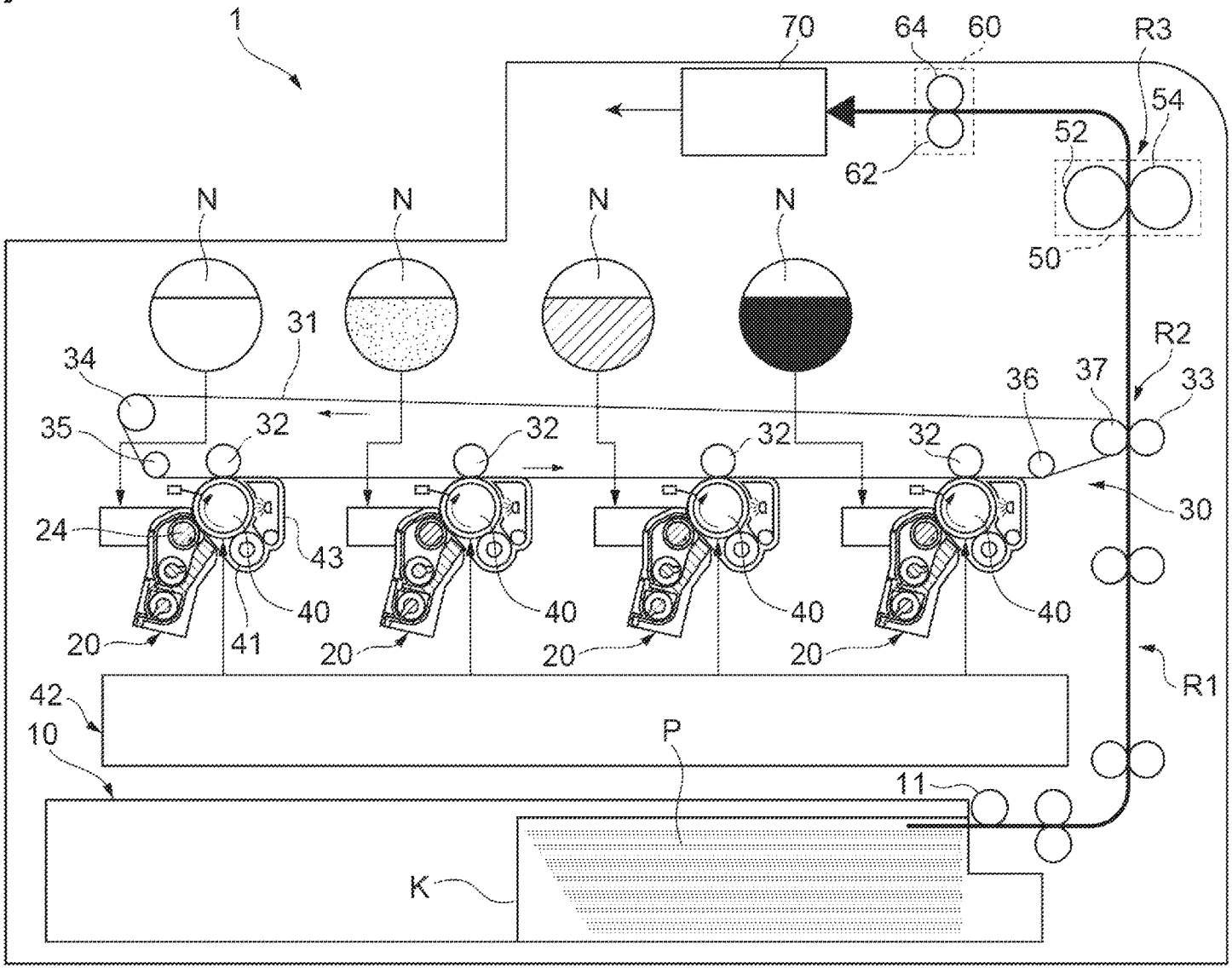
FIG. 1 is a schematic diagram of an example image forming apparatus.

With reference to FIG. 1, an example image forming apparatus 1 forms a color image by using respective colors of magenta, yellow, cyan, and black. The image forming apparatus 1 may include, for example, a conveying device 10 which conveys a sheet P corresponding to a recording medium, a developing device 20 which develops an electrostatic latent image, a transfer device 30 which secondarily transfers the developed image to the sheet P, an image carrier 40 of which a surface (e.g., a peripheral surface) is provided with an electrostatic latent image, a fixing device 50 which fixes the transferred image to the sheet P, a discharging device 60 which discharges the sheet P, and a gloss treatment device (or gloss processing device) 70. In the present disclosure, an imaging system may according to some examples, include an imaging apparatus such as the image forming apparatus 1, a printer, a copying apparatus or the like, or in other examples, a component or sub-system thereof such as a gloss treatment device for example.

The conveying device 10 conveys, for example, the sheet P which is a recording medium on a conveying route R1. Sheets P are accommodated in, for example, a cassette K in a stacked state and are picked up and conveyed by a feeding roller 11. The conveying device 10 allows the sheet P to reach a transfer nip portion R2 through the conveying route R1, for example, at a timing when the developed image on the transfer belt which would be transferred onto the sheet P reaches the transfer nip portion R2.

Four developing devices 20 may be provided for the four colors, respectively. Each developing device 20 includes, for example, a developer carrier 24 which carries toner to be transferred onto the image carrier 40. In the developing device 20, for example, a two-component developer including toner and carrier may be used as a developer. In the developing device 20, the toner and the carrier may be adjusted to a selected or target mixing ratio, and the toner and the carrier may be mixed and stirred so that the toner is uniformly dispersed, to obtain a developer applied with an optimal or target charge amount. The developer is carried on the developer carrier 24. The developer carrier 24 rotates so as to convey the developer to a region facing the image carrier 40. Then, the toner of the developer carried on the developer carrier 24 moves to an electrostatic latent image formed on the peripheral surface of the image carrier 40 so that the electrostatic latent image is developed.

The transfer device 30 conveys, for example, the developed image formed by the developing device 20 to the transfer nip portion R2 where the image is secondarily transferred to the sheet P, The transfer device 30 includes, for example, a transfer belt 31 to which the developed image is primarily transferred from the image carrier 40, tension rollers 34, 35, 36, and 37 which tension the transfer belt 31, a primary transfer roller 32 which presses the transfer belt 31 against the image carrier 40, and a secondary transfer roller 33 which presses the transfer belt 31 against the tension roller 37.

The transfer belt 31 is, for example, an endless belt which moves in a circulating manner by the tension rollers 34, 35, 36, and 37. The tension rollers 34, 35, 36, and 37 are rollers which are rotatable about their axes. The tension roller 37 is, for example, a drive roller which rotates about its axis in a driving manner. The tension rollers 34, 35, and 36 are, for example, driven rollers which rotate in a driven manner in response to the rotational driving of the tension roller 37. The primary transfer roller 32 may, for example, press the image carrier 40 from the inner peripheral side of the transfer belt 31. The secondary transfer roller 33 is disposed, for example, in parallel to the tension roller 37 with the transfer belt 31 interposed therebetween and is provided to press the tension roller 37 from the outer peripheral side of the transfer belt 31. Accordingly, the secondary transfer roller 33 forms the transfer nip portion R2 between the secondary transfer roller and the transfer belt 31.

The image carrier 40 may include an electrostatic latent image carrier such as a photosensitive drum, and the like, for example. Four image carriers 40 may be provided, for example, for the four colors, respectively. The image carriers 40 may be positioned, for example, along the movement direction of the transfer belt 31. In some examples, the developing device 20, the charging roller 41, the exposure unit 42, and the cleaning device 43 are provided on the periphery of or about the image carrier 40.

The charging roller 41 is, for example, is a charger that uniformly charges the surface of the image carrier 40 to a predetermined potential. The charging roller 41 moves, for example, in accordance with the rotation of the image carrier 40. The exposure unit 42 exposes, for example, the surface of the image carrier 40 charged by the charging roller 41 with the image which will be formed on the sheet P. Accordingly, a potential of a portion of the surface of the image carrier 40 that is exposed to the exposure unit 42 changes so that an electrostatic latent image is formed. For example, four developing devices 20 generate respective toner images by developing the electrostatic latent image formed on the image carriers 40 with toner supplied from toner tanks N, respectively. The toner tanks N are filled with, for example, the toners of magenta, yellow, cyan, and black, respectively. The cleaning device 43 collects, for example, the toner remaining on the image carrier 40 after the toner formed on the image carrier 40 is primarily transferred to the transfer belt 31.

The fixing device 50 allows, for example, the sheet P to pass through a fixing nip portion R3 for heating and pressing the sheet so that the developed image secondarily transferred from the transfer belt 31 to the sheet P is attached and fixed to the sheet P. The fixing device 50 includes, for example, a heating roller 52 which heats the sheet P and a pressing roller 54 which rotates in a driving manner while pressing the heating roller 52. The heating roller 52 and the pressing roller 54 are formed, for example, in a cylindrical shape, and the heating roller 52 includes a heat source such as a halogen lamp provided therein. The fixing nip portion R3 corresponding to a contact region is provided between the heating roller 52 and the pressing roller 54, and the sheet P passes through the fixing nip portion R3 so that the toner is melted and fixed to the sheet P.

The discharging device 60 includes, for example, discharging rollers 62 and 64 which discharge the sheet P to which the toner is fixed by the fixing device 50 to the outside of the apparatus.

An example of a printing process of the image forming apparatus 1 will be described. When an image signal of a recording target image is input to the image forming apparatus 1, a control unit of the image forming apparatus 1 rotates the feeding roller 11 so as to pick up and convey the sheets P stacked on the cassette K. Then, the surface of the image carrier 40 is uniformly charged to a predetermined potential by the charging roller 41 (e.g., a charging operation). Subsequently, the surface of the image carrier 40 is irradiated with a laser beam by the exposure unit 42 based on the received image signal so that an electrostatic latent image is formed (e.g., an exposure operation).

In the developing device 20, the electrostatic latent image is developed with toner (e.g., a developing operation). The toner image formed in this way is primarily transferred from the image carrier 40 to the transfer belt 31 in a region in which the image carrier 40 faces the transfer belt 31 (e.g., a transfer operation). The toner images formed on the four image carriers 40 are sequentially layered on the transfer belt 31 so that a single composite toner image is formed. Then, the composite toner image is secondarily transferred to the sheet P conveyed from the conveying device 10 in the transfer nip portion R2 in which the tension roller 37 faces the secondary transfer roller 33.

The sheet P to which the composite toner image is secondarily transferred is conveyed to the fixing device 50. Then, the fixing device 50 heats and presses the sheet P between the heating roller 52 and the pressing roller 54 when the sheet P passes through the fixing nip portion R3 so that the composite toner image is melted and fixed to the sheet P (e.g., a fixing operation). Subsequently, the sheet P is discharged toward the gloss treatment device 70 by the discharging rollers 62 and 64.

The gloss treatment device 70 may perform gloss treatment on the sheet P to which the toner image has been fixed by the fixing device 50. In some example, the gloss treatment device 70 is disposed on the downstream side (e.g., the outside) of the discharging device 60 in the conveying direction as described herein. In other examples, the gloss treatment device may be disposed between the fixing device 50 and the discharging device 60, or in yet other examples, the gloss treatment device may be attached to the discharging device 60. The image forming apparatus 1 includes, for example, a gloss printing mode and a normal printing mode. The gloss printing mode is a mode in which the sheet P with the toner image fixed thereto is supplied to the gloss treatment device 70. The normal printing mode is a mode in which the sheet P with the toner image fixed thereto is not supplied to the gloss treatment device 70, but is discharged to the outside of the image forming apparatus. The gloss printing mode and the normal printing mode may be switched by, for example, a setting that is input by the user.

Figure 2:
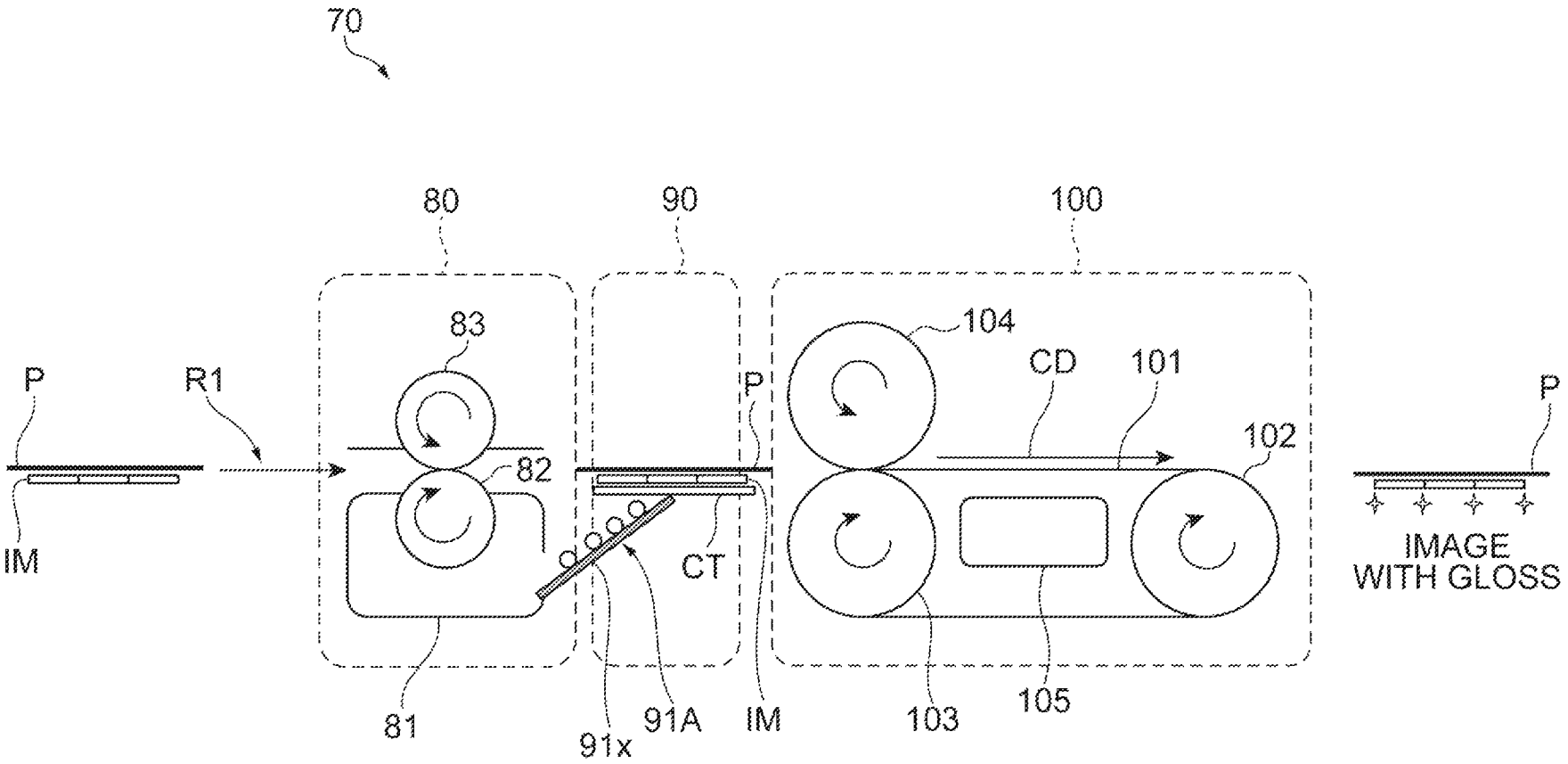
FIG. 2 is a schematic diagram of an example gloss treatment device.

The example gloss treatment device 70 may include, with reference to FIG. 2, a clear toner transfer unit (or gloss toner transfer device) 80, a leveling unit (or leveling device) 90, and a gloss adding unit (or glossing device) 100.

The clear toner transfer unit (or gloss toner transfer device) 80 transfers gloss toner, such as a clear toner (or transparent toner) CT for example, to an image surface of the sheet P, which corresponds to a surface of the sheet P having an image IM (e.g., a cyan-magenta-yellow-black image (CMYK image)) formed thereon. The clear toner transfer unit 80 includes a developing device 81 (or a developing unit), an image carrier 82, and a transfer roller 83. The developing device 81 includes, for example, a developer carrier which carries the clear toner CT and transfers the clear toner CT onto the image carrier 82. The image carrier 82 develops the electrostatic latent image, for example, in such a manner that the clear toner CT of the developer carried by the developer carrier of the developing device 81 moves to the electrostatic latent image formed on the peripheral surface thereof. A charging roller, an exposure unit, and a cleaning device may be provided on the periphery of (or about) the image carrier 82 as well as the developing device 81. The transfer roller 83 is a roller having a rotation axis, which faces the image carrier 82 and rotates about its axis. The transfer roller 83 presses against the image carrier 82. According to such a configuration, the clear toner CT is transferred to the sheet P at a region in which the image carrier 82 faces the transfer roller 83.

The leveling unit 90 is disposed on the downstream side of the clear toner transfer unit 80 in the conveying direction (or conveyance direction) CD of the sheet P and is used to level the layer of the clear toner CT of the image surface. The leveling unit 90 levels the layer of the clear toner CT so that the clear toner CT moves from a convex portion to a concave portion of the layer of the clear toner CT before the gloss adding unit 100 performs a re-melting process and a cooling process, which will be described further below. A configuration of the leveling unit 90 will be described further below.

The gloss adding unit 100 is disposed on the downstream side of the leveling unit 90 in the conveying direction CD and sequentially performs a re-melting process, a cooling process, and a peeling process on the sheet P after the layer of the clear toner CT is leveled by the leveling unit 90. The gloss adding unit 100 includes, for example, a conveyor belt 101, a tension roller 102, a heating roller 103, a pressing roller 104, and a cooling device 105.

The conveyor belt 101 is an endless belt which conveys the sheet P. The tension roller 102 is a roller which engages with the conveyor belt 101. The tension roller 102 is disposed on the downstream side of the heating roller 103, the pressing roller 104 and the cooling device 105, in the conveying direction CD. Two or more tension rollers 102 may be provided in some examples. The heating roller 103 is a roller which engages with the conveyor belt 101 and heats the conveyor belt 101. The pressing roller 104 is a roller which is disposed on the side opposite to the heating roller 103 with respect to the conveyor belt 101 and presses the conveyor belt 101 against the heating roller 103. The tension roller 102, the heating roller 103, and the pressing roller 104 may be driven rollers or driving rollers. When the sheet P passes through the nip portion between the heating roller 103 and the pressing roller 104, heat and pressure are applied to the image IM formed on the sheet P so that the toner associated with the image IM is re-melted (e.g., a re-melting process), and so that the toner adheres to the surface of the conveyor belt 101. The cooling device 105 is disposed between the heating roller 103 and the tension roller 102 in the conveying direction CD and cools the conveyor belt 101 and the sheet P so that the toner image re-melted by the heating roller 103 and the like is cooled and solidified (e.g., a cooling process). In the cooling process, the surface shape of the conveyor belt 101 is transferred to the surface of the image IM so that the surface of the image IM is flattened. The cooling device 105 includes, for example, a heat sink, a cooling fan, a heat pipe, and/or a pettier device. In the gloss adding unit 100, the cooled sheet P is separated from the conveyor belt 101 (e.g., a peeling process).

Various example configurations of the leveling unit 90 will be described with reference to FIGS. 3 to 18. For ease of understanding, the image IM illustrated in FIG. 2 is not illustrated in FIGS. 3 to 18.

Figure 3:
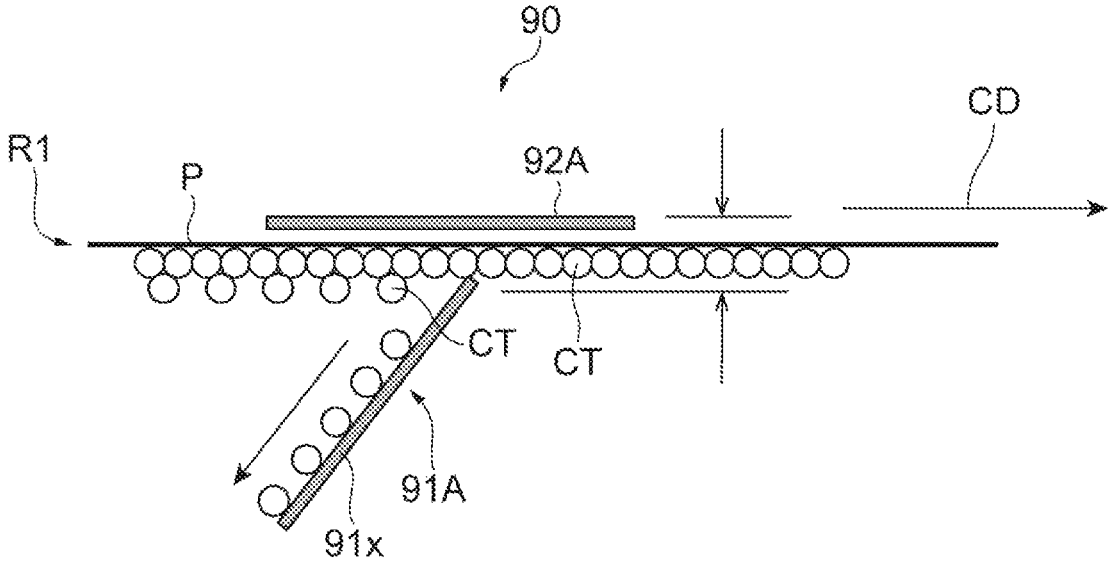
FIG. 3 is a schematic diagram of an example leveling device for gloss toner.

With reference to FIG. 3, in one example, the leveling unit (or leveling device) 90 includes a blade member (or blade device) 91A and a guide member (or guide device or guide) 92A. The guide member 92A is a flat member that is provided in contact with a surface opposite to the image surface in the sheet P and guides the conveying of the sheet P along the conveying route (or conveyance path) R1. The blade member 91A is a blade-shaped member that extends toward the image surface of the sheet P and scrapes off a part of the layer of the clear toner CT exceeding a predetermined thickness. The blade member 91A may be formed of, for example, resin, metal, rubber, or the like. The blade member 91A extends toward the image surface of the sheet P (or toward the conveyance path or conveyance route R1), from the upstream side to the downstream side in the conveying direction CD. The blade member 91A has a first end which is a proximal end (or base end) located at the upstream side, and a second end which is a tip end located at the downstream side. The tip end is located closer to the image surface than the proximal end (or base end). For example, the blade member 91A is inclined (e.g., not perpendicular to the image surface) and is provided so that its proximal end (e.g., the first end opposite to the image surface) is offset to the upstream side of the conveying direction CD with respect to the tip end adjacent the image surface (e.g., the blade member 91A is angularly offset from a direction perpendicular to the image surface). The blade member 91A scrapes off a part of the layer of the clear toner CT exceeding a predetermined thickness at its tip end, which is the second end closest to the image surface, A separation distance between the tip of the blade member 91A and the surface guiding the sheet P in the guide member 92A is suitably set in the leveling unit 90 according to a predetermined layer thickness, so that the portion of the layer of the clear toner CT exceeding the predetermined thickness is scraped off when contacting the tip (e.g., the tip end) of the blade member 91A. The blade member 91A includes a toner recovery unit (or toner recovery device) 91*x*. The toner recovery unit 91*x* is a portion which extends toward the developing device 81 to return the scraped clear toner CT to the developing device 81 (see FIG. 2). That is, the clear toner CT exceeding the predetermined thickness is scraped off by the tip of the blade member 91A and is returned (collected) to the developing device 81 through the toner recovery unit 91*x* of the blade member 91A.

Figure 4:
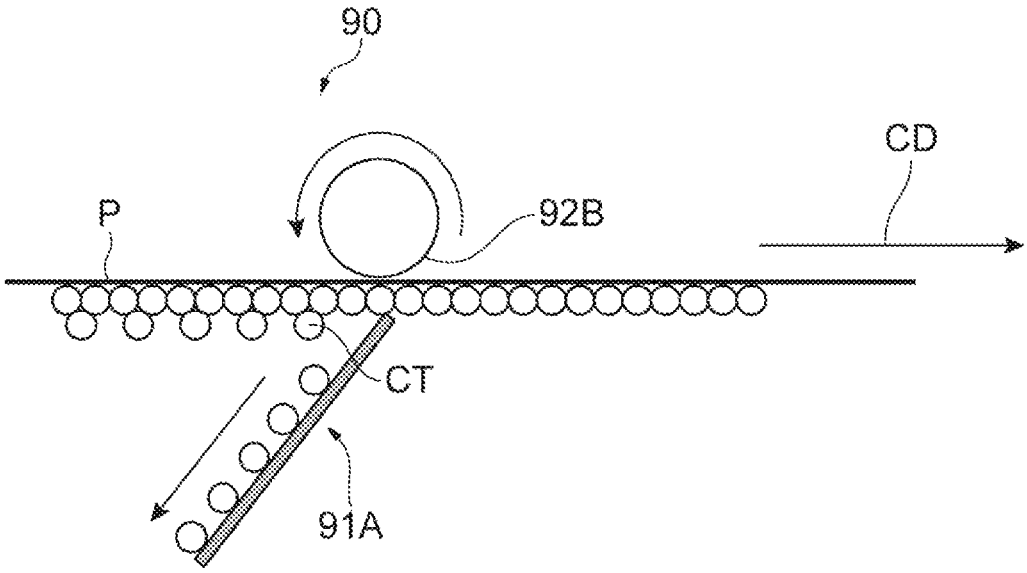
FIG. 4 is a schematic diagram of an example leveling device for gloss toner.

With reference to FIG. 4, in one example, the leveling unit (or leveling device) 90 includes the blade member (or blade device) 91A and a guide member (or guide device) 92B. The guide member 92B is a roller member that is provided in contact with a surface of the sheet P that is opposite to the image surface of the sheet P, and guides the conveying of the sheet P. The guide member 92B may be a driven roller or a drive roller. The guide member 92B rotates so as to guide the sheet P in the conveying direction CD. Since the guide member 92B is configured as the roller member, the sheet P may be more smoothly conveyed and the sheet P may be guided in more stable manner.

Figure 5:
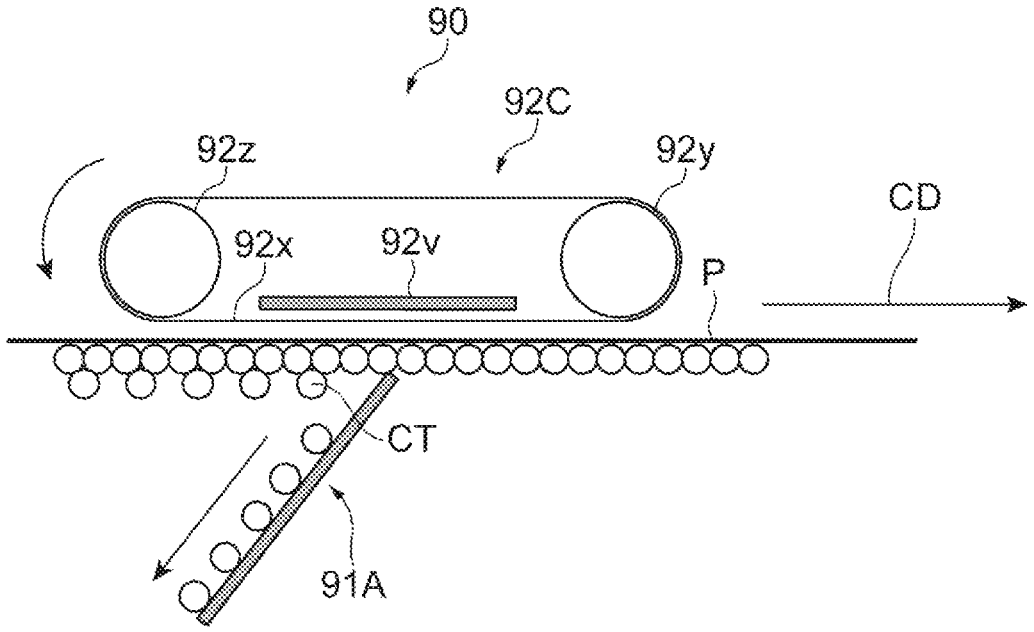
FIG. 5 is a schematic diagram of an example leveling device for gloss toner.

With reference to FIG. 5, in one example, the leveling unit (or leveling device) 90 includes the blade member (or blade device) 91A and a guide member (or guide device or guide)

92C. The guide member 92C is a belt-shaped member that is provided in contact with the surface opposite to the image surface of the sheet P and guides the conveying of the sheet P along the conveyance path or route R1. The guide member 92C includes a conveyor belt 92*x*, tension rollers 92*y* and 92*z*, and a flat member 92*v*. The conveyor belt 92*x* is an endless belt which conveys the sheet P. The tension rollers 92*y* and 92*z* are rollers which engage with the conveyor belt 92*x*. The tension rollers 92*y* and 92*z* may be driven rollers or drive rollers. The flat member 92*v* is a member that is disposed between the tension rollers 92*y* and 92*z* in the conveying direction CD and positions the conveyor belt 92*x* so that the conveyor belt 92*x* may have a better contact with the sheet P. Since the guide member 92C is configured as the belt-shaped member (a member including the conveyor belt 92*x*), the sheet P can be conveyed on the surface and the sheet P can be guided in a more stable manner.

Figure 6:
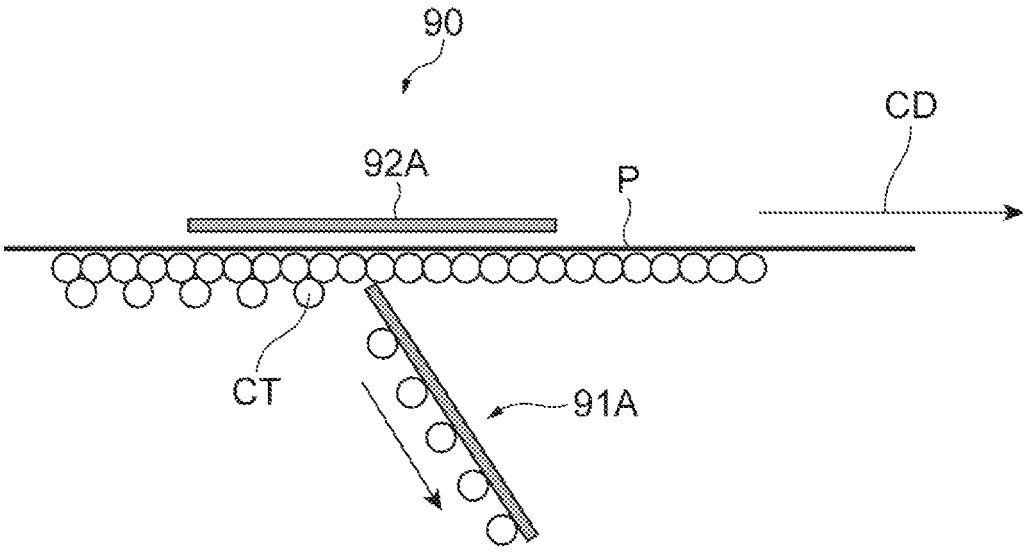
FIG. 6 is a schematic diagram of an example leveling device for gloss toner.

With reference to FIG. 6, in one example, the leveling unit (or leveling device) 90 may include the blade member 91A which extends toward the image surface of the sheet P (or toward the conveyance path or route R1), from the downstream side to the upstream side in the conveying direction CD. For example, the blade member 91A is inclined (e.g., not perpendicular to the image surface) and is provided so that its distal end is offset toward the downstream side of the conveying direction CD with respect to its proximal end, such that the blade member 91A is angularly offset relative to a direction perpendicular to the image surface. By the arrangement of the blade member 91A illustrated in FIG. 6, a frictional force applied from the tip of the blade member 91A to the layer of the clear toner CT may be increased as compared with examples in which the blade member 91A is disposed as illustrated in FIGS. 3 to 5.

Figure 7B:
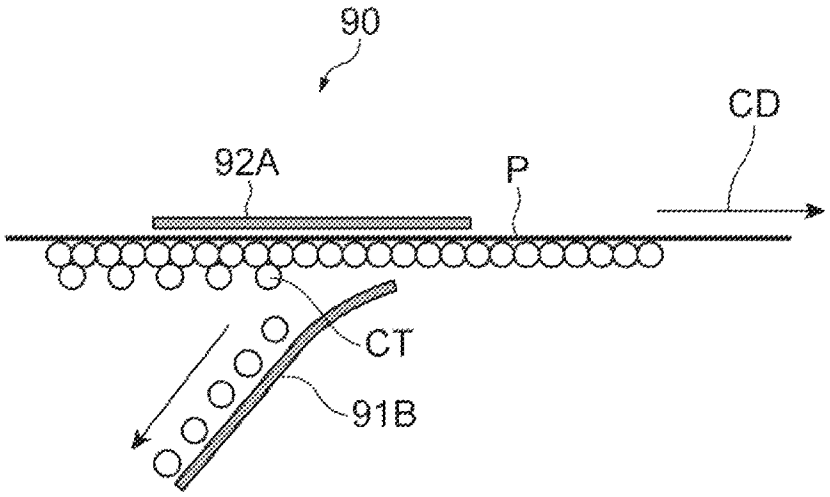
FIG. 7B is a schematic diagram of the example gloss toner leveling device of FIG. 7A, illustrated in a second operational state.
Figure 7A:
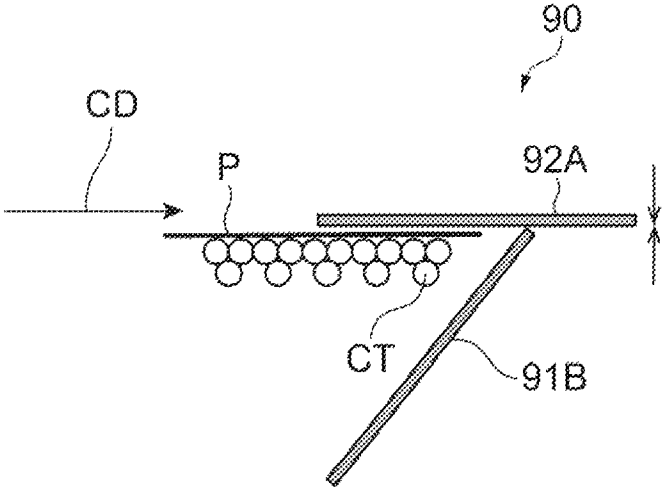
FIG. 7A is a schematic diagram of an example leveling device for gloss toner, illustrated in a first operational state.

With reference to FIGS. 7A and 7B, in one example, the leveling unit (or leveling device) 90 includes a blade member (or blade device) 91B and the guide member (or guide device) 92A. The blade member 91B is formed of a flexible material, for example, a material which is highly flexible so as to be bent by the force conveying the sheet P. As illustrated in FIG. 7A, the tip of the blade member 91B is pressed against the guide member 92A in a state in which the sheet P does not reach the blade member. Then, as illustrated in FIG. 7B, when the blade member 91B contacts the conveyed sheet P, the blade member is bent along the sheet P by the force of the sheet P being conveyed. Since the blade member 91B is bent by the force conveying the sheet P, the conveying of the sheet P is not disturbed or disrupted by the member 91B. The blade member 91B extends so that its tip (or tip end) contacts the guide member 92A in a state in which the blade member 91B is not bent (e.g., when the blade is substantially, before the bending), the clear toner CT can be scraped off by a sufficiently strong force (e.g., resilience of the flexible material of the blade member 91B). Additionally, a force of the blade member 91B pressed against the guide member 92A may be changeable in response to or based on the thickness of the sheet P. The thickness of the sheet P may be calculated from predetermined sheet information or detected by a sheet thickness sensor.

Figure 8:
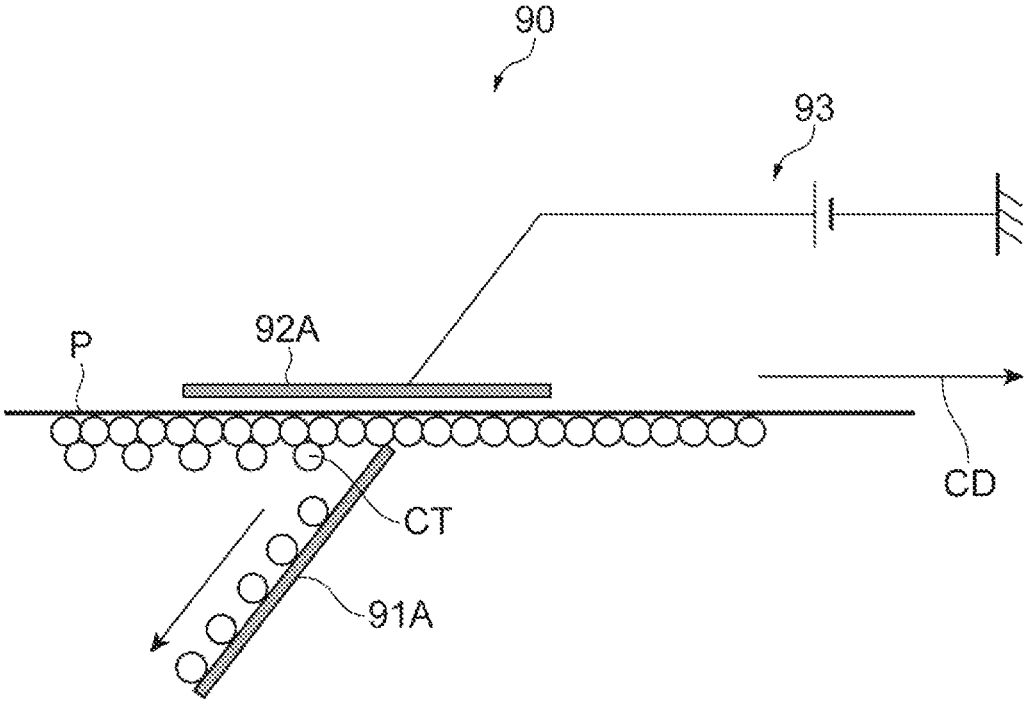
FIG. 8 is a schematic diagram of an example leveling device for gloss toner.

With reference to FIG. 8, in one example, the leveling unit (or leveling device) 90 includes the blade member (or blade device) 91A, the guide member (or guide device) 92A, and a voltage application unit (or an application unit, or voltage application device) 93. The voltage application unit (or voltage application device) 93 applies a voltage to the guide member 92A so that the clear toner CT is attracted to the image surface of the sheet P. For example, when the clear toner CT is negatively charged, the voltage application unit 93 applies a positive voltage to the guide member 92A so that the negatively charged clear toner CT is attracted toward the guide member 92A and therefore, toward the sheet P. Accordingly, the blade member 91A may scrape off the extra (or excess) clear toner CT, in a state in which the clear toner CT is suitably attracted toward the image surface of the sheet P.

Figure 9:
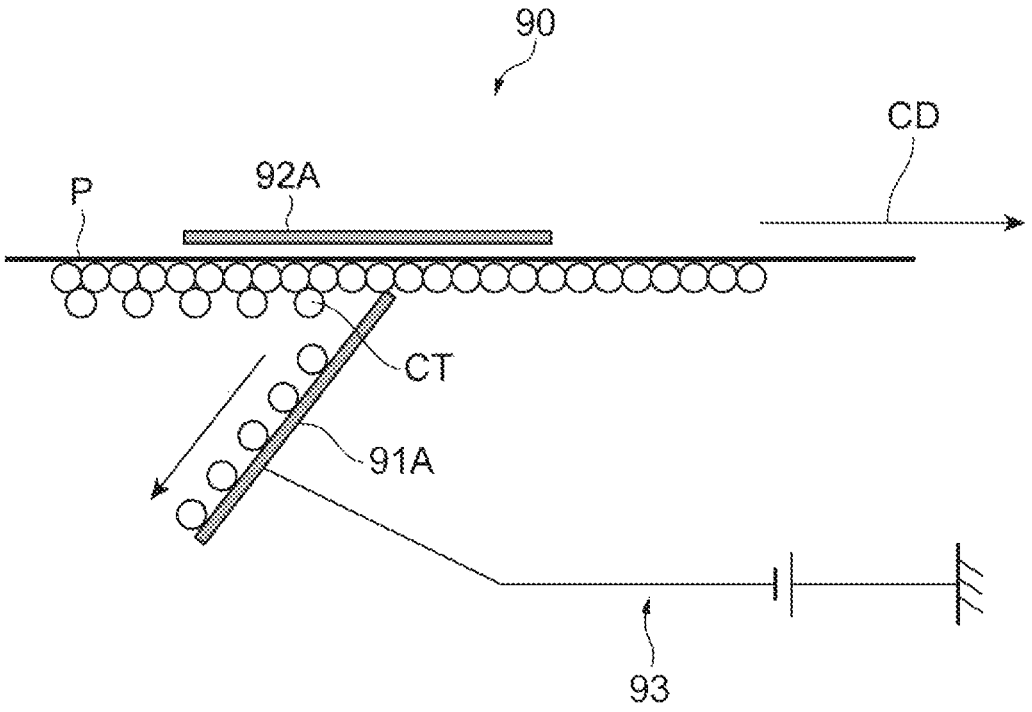
FIG. 9 is a schematic diagram of an example leveling device for gloss toner.

With reference to FIG. 9, in one example, the leveling unit (leveling device) 90 includes the blade member (or blade device) 91A, the guide member (or guide device) 92A, and the voltage application unit (e.g., an application unit or voltage application device) 93 similarly to the example illustrated in FIG. 8. In the example illustrated in FIG. 9, the voltage application unit 93 applies a voltage to the blade member 91A so that the clear toner CT is attracted toward the image surface of the sheet P. For example, when the clear toner CT is mainly negatively charged, the voltage application unit 93 applies a negative voltage to the blade member 91A so that the negatively charged clear toner CT is attracted toward the sheet P, away from the blade member 91A. Accordingly, the excess clear toner CT can be scraped off by the blade member 91A in a state in which the clear toner CT is appropriately attracted toward the image surface of the sheet P. Further, a voltage may be applied to the blade member 91A in a direction in which the clear toner CT moves away from the blade member 91A so that the excess clear toner CT is suitably conveyed toward the developing device 81 through the toner recovery unit 91*x*.

Figure 10:
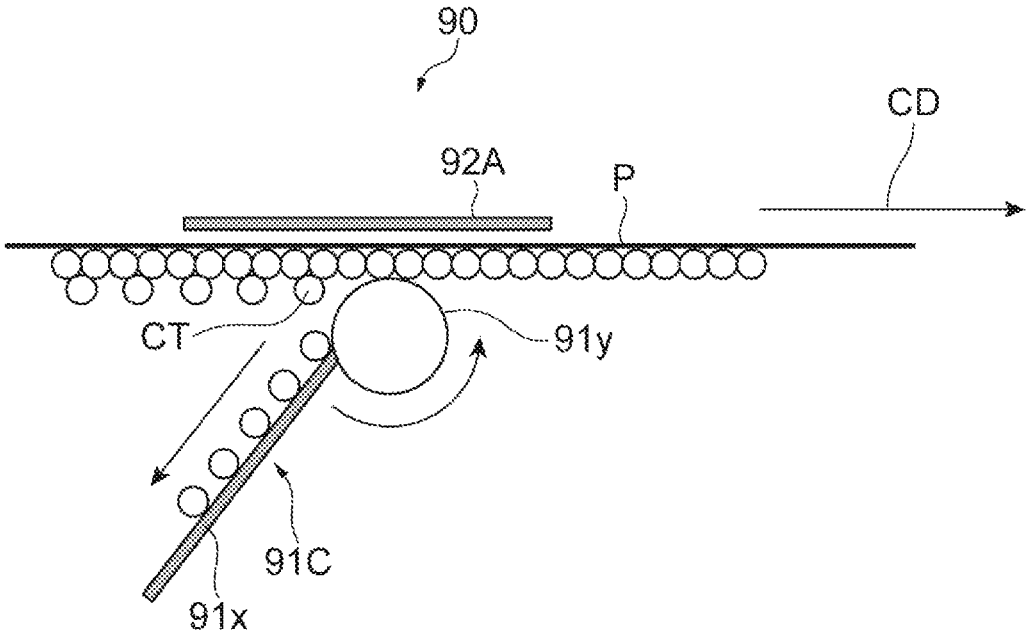
FIG. 10 is a schematic diagram of an example leveling device for gloss toner.
Figure 11A:
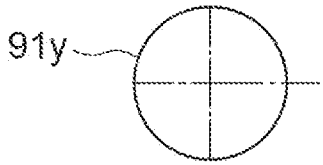
FIG. 11A is a schematic side plan view of an example scraping roller.
Figure 11B:
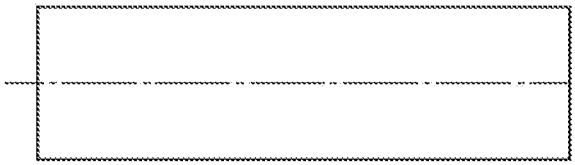
FIG. 11B is a schematic front plan view of the example scraping roller illustrated in FIG. A.
Figure 11C:
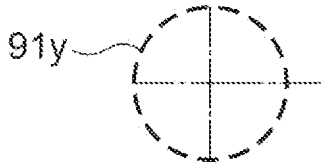
FIG. 11C is a schematic side plan view of an example scraping roller.
Figure 11D:
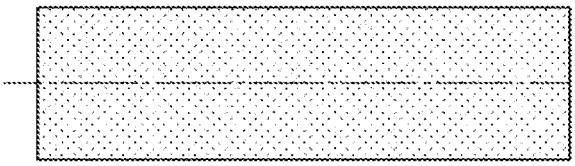
FIG. 11D is a schematic front plan view of the example scraping roller illustrated in FIG. 11C.
Figure 11E:
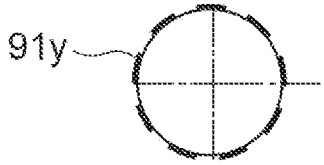
FIG. 11E is a schematic side plan view of an example scraping roller.
Figure 11F:
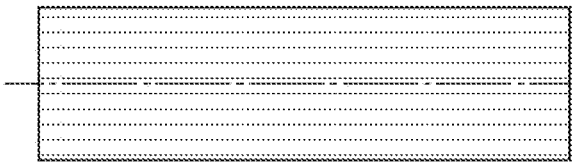
FIG. 11F is a schematic front plan view of the example scraping roller illustrated in FIG. 11E.
Figure 11G:
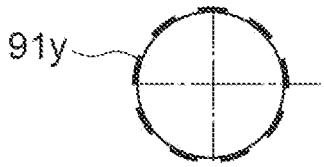
FIG. 11G is a schematic side plan view of an example scraping roller.
Figure 11H:
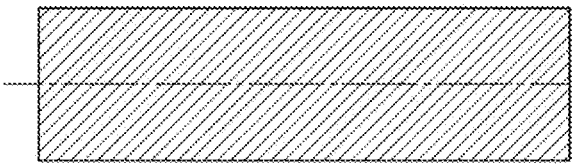
FIG. 11H is a schematic front plan view of the example scraping roller illustrated in FIG. 11G.

With reference to FIG. 10, in example, the leveling unit (or leveling device) 90 includes a blade member (or blade device) 91C and the guide member (or guide device) 92A. The blade member 91C includes the toner recovery unit 91*x* and a scraping roller 91*y* (a rotation portion). The blade member 91C extends toward the image surface of the sheet P (or toward the conveyance path or route R1). The scraping roller 91*y* is a roller provided at the tip end of the blade member 91C, which scrapes off a part of the layer of the clear toner CT in a rotation state, and sends or transfers the scraped clear toner CT to the toner recovery unit 91*x*. The scraping roller 91*y* rotates in a direction opposite to the conveying direction CD of the sheet P. FIGS. 11A to 11G are diagrams illustrating variations of the scraping roller 91*y*. The surface (the peripheral or circumferential surface) of the scraping roller 91*y* may be smooth as illustrated in FIGS. 11A and 11B or may be uneven as illustrated in FIGS. 11C to 11H. In the example illustrated in FIGS. 11C and 11D, the surface of the scraping roller 91*y* has a rough shape. With reference to FIGS. 11E and 11F, the scraping roller 91*y* may include grooves formed on the circumferential surface. For example the grooves may be formed in the longitudinal direction or in the circumferential direction of the roller. In the example illustrated in FIGS. 11G and 11H, the surface of the scraping roller 91*y* has a shape in which a groove is formed so as to be inclined with respect to the circumferential direction (substantially in a spiral direction about the circumference of the roller).

Figure 12:
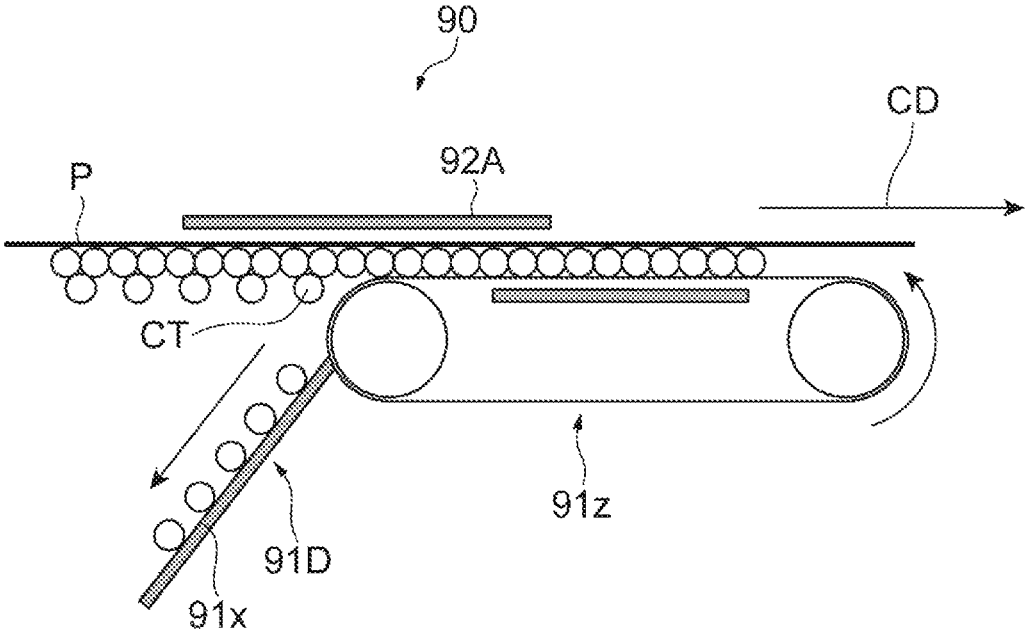
FIG. 12 is a schematic diagram of an example leveling device for gloss toner.

With reference to FIG. 12, in one example, the leveling unit (or leveling device) 90 includes a blade member (or blade device) 91D and the guide member (or guide device) 92A. The blade member 91D includes the toner recovery unit 91*x* and a scraping belt 91*z*. The configuration of the scraping belt 91*z* is similar to that of the belt-shaped guide member 92C illustrated in FIG. 5 in that the conveyor belt, the tension roller, and the flat member are provided. The scraping belt 91*z* is provided at the tip end of the blade member 91D, to rotate while contacting the surface of the layer of the clear toner CT, to scrape off a part of the layer of the clear toner CT, and to send (or transfer) the scraped clear toner CT to the toner recovery unit 91*x*. The scraping belt 91*z* rotates in a direction opposite to the conveying direction CD of the sheet P.

Figure 13:
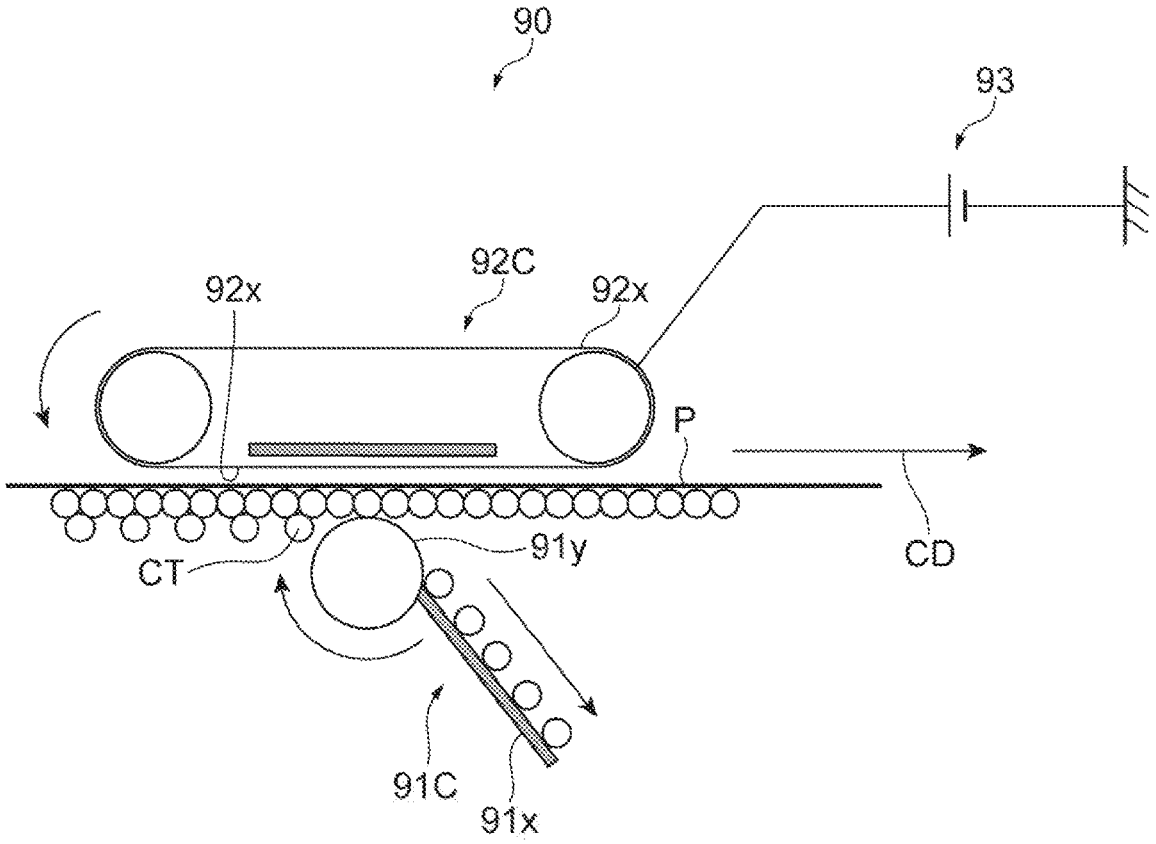
FIG. 13 is a schematic diagram of an example leveling device for gloss toner.

With reference to FIG. 13, in one example, the leveling unit (or leveling device) 90 includes a blade member (or blade device) 91C, the guide member (or guide device) 92C, and the voltage application unit 93. The blade member 91C extends toward the image surface against the conveying direction CD. The scraping roller 91*y* of the blade member 91C rotates in a direction that cooperates with the conveying of the sheet P (toward the same direction as the conveying direction CD along the conveyance path R1). The rotation speed of the scraping roller 91*y* is set to a speed at which the clear toner CT can be collected (scraped) based on the conveying speed of the sheet P. The rotation speed of the scraping roller 91*y* may be different from the conveying speed of the sheet P. For example, the rotation speed may be faster than the rotation speed of the conveyor belt 92*x* of the guide member 92C conveying the sheet P. For example, a rotation speed of the scraping roller 91*y* that is the same as the conveying speed of the sheet P, may prevent or inhibit the scraping roller 91*y* from scraping off the clear toner CT. Accordingly, the rotation speed of the scraping roller 91*y* may be controlled to be different from the conveying speed of the sheet P, so that the scraping roller 91*y* may more reliably scrape off the clear toner CT. The voltage application unit 93 applies a voltage to the conveyor belt 92*x* of the guide member 92C so that the clear toner CT is attracted toward the image surface of the sheet P. For example, when the clear toner CT is mainly negatively charged, the voltage application unit 93 may apply a positive voltage to the conveyor belt 92*x* so that the negatively charged clear toner CT is attracted toward the conveyor belt 92*x* (and therefore, toward the sheet P).

Figure 14:
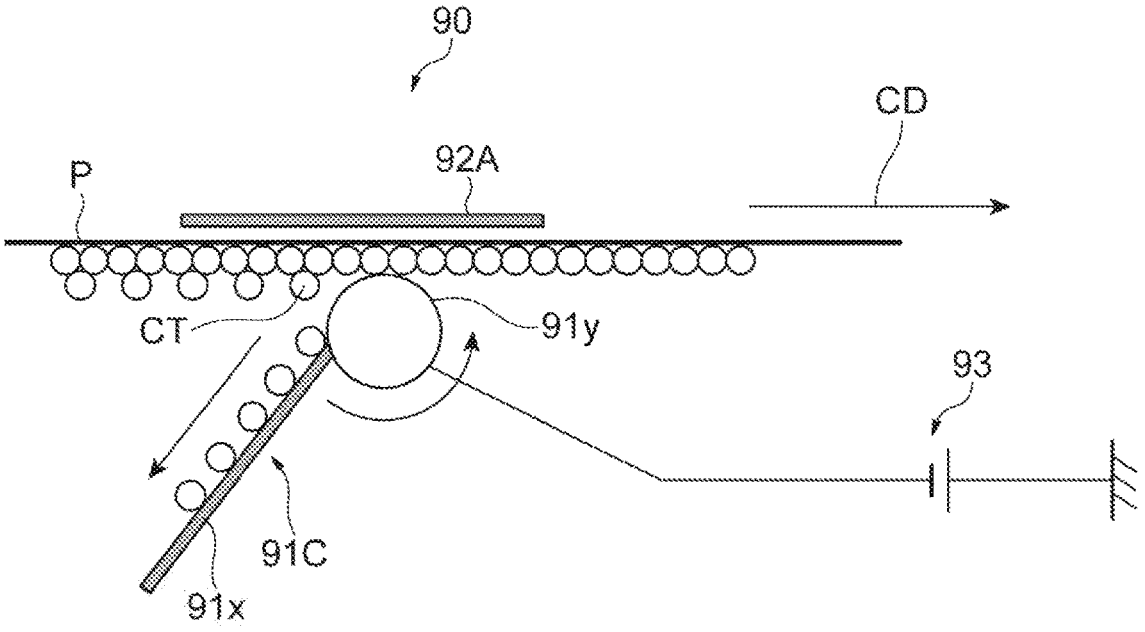
FIG. 14 is a schematic diagram of an example leveling device for gloss toner.

With reference to FIG. 14, in one example, the leveling unit (or leveling device) 90 includes the voltage application unit (or voltage application device) 93 in addition to a configuration similar to the configuration illustrated in FIG. 10. The voltage application unit 93 applies a voltage to the scraping roller 91*y* of the blade member 91C so that the clear toner CT is attracted toward the image surface of the sheet P. For example, when the clear toner CT is mainly negatively charged, the voltage application unit 93 applies a negative voltage to the scraping roller 91*y* so that the negatively charged clear toner CT is attracted in a direction away from the scraping roller 91*y* (that is, toward the sheet P).

Figure 15:
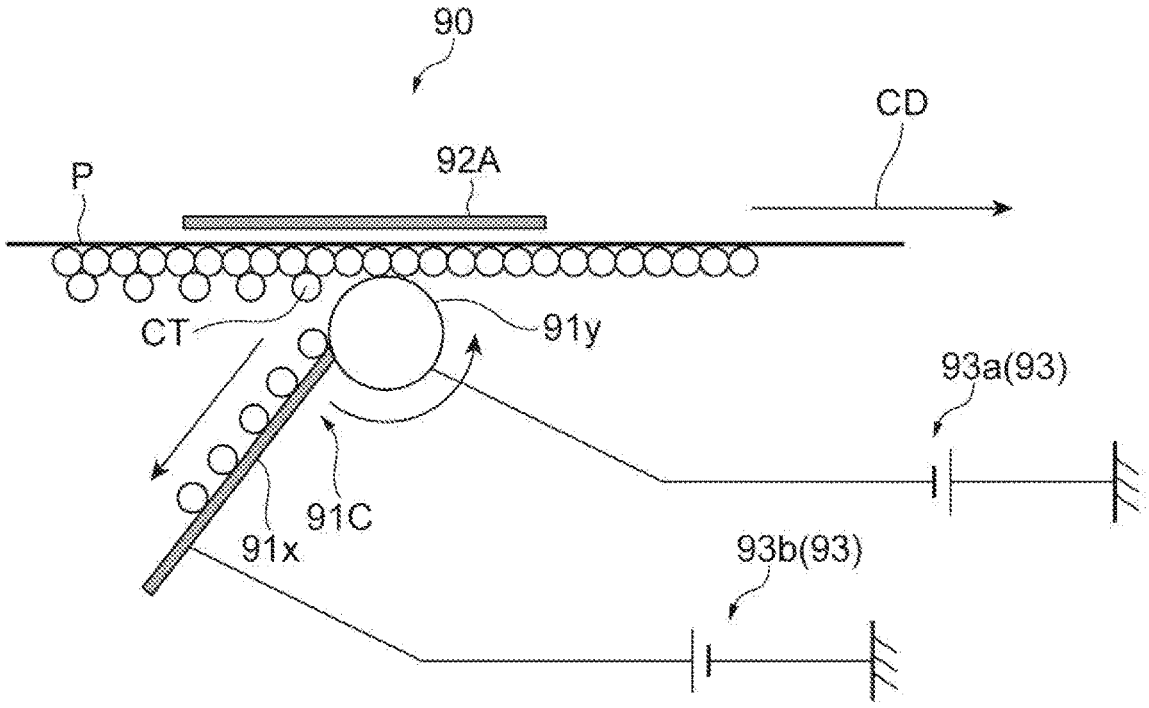
FIG. 15 is a schematic diagram of an example leveling device for gloss toner.

With reference to FIG. 15, in one example, the leveling unit (or leveling device) 90 includes the voltage application unit (or voltage application device) 93 including two voltage application units (or voltage application devices) 93*a* and 93*b* in addition to a configuration similar to the configuration illustrated in FIG. 10. The voltage application unit 93*a* applies a voltage to the scraping roller 91*y* of the blade member 91C so that the clear toner CT is attracted toward the image surface of the sheet P. The voltage application unit 93*b* applies a voltage to the toner recovery unit 91*x* of the blade member 91C so that the clear toner CT scraped off by the scraping roller 91*y* is more efficiently collected by the toner recovery unit 91*x*. For example, when the clear toner CT is mainly negatively charged, the voltage application unit 93*a* applies a negative voltage to the scraping roller 91*y* and applies a positive voltage to the toner recovery unit 91*x*.

Figure 16:
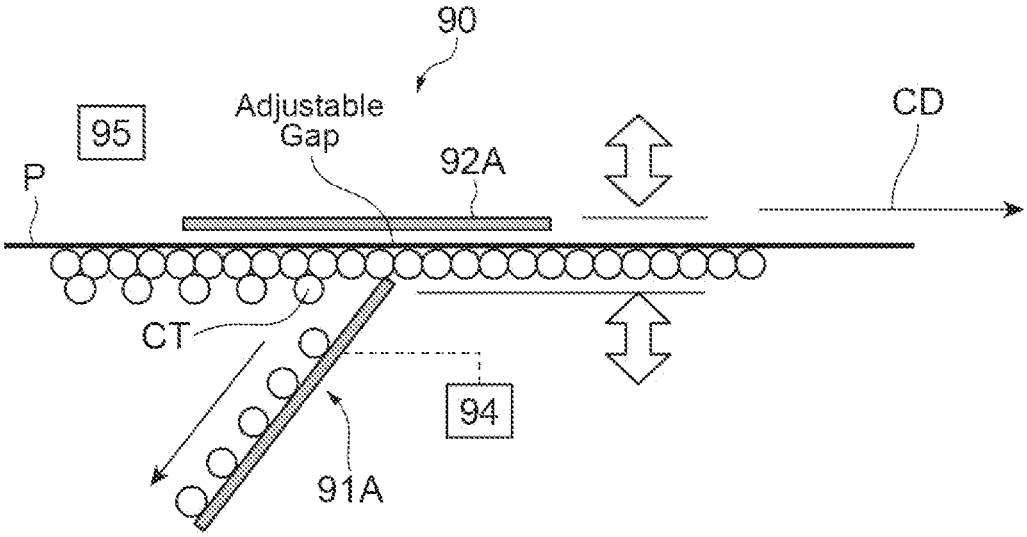
FIG. 16 is a schematic diagram of an example leveling device for gloss toner.

With reference to FIG. 16, in one example, the leveling unit (or leveling device) 90 includes the blade member (or blade device) 91A and the guide member (or guide device) 92A and changes a gap between the blade member 91A and the guide member 92A based on the thickness of the sheet P. The leveling unit 90 includes an adjustment mechanism 94 to adjust a gap between the blade member 91A and the guide member 92A. The thickness of the sheet P may be calculated from predetermined sheet information or detected by a sheet thickness sensor 95.

Figure 17:
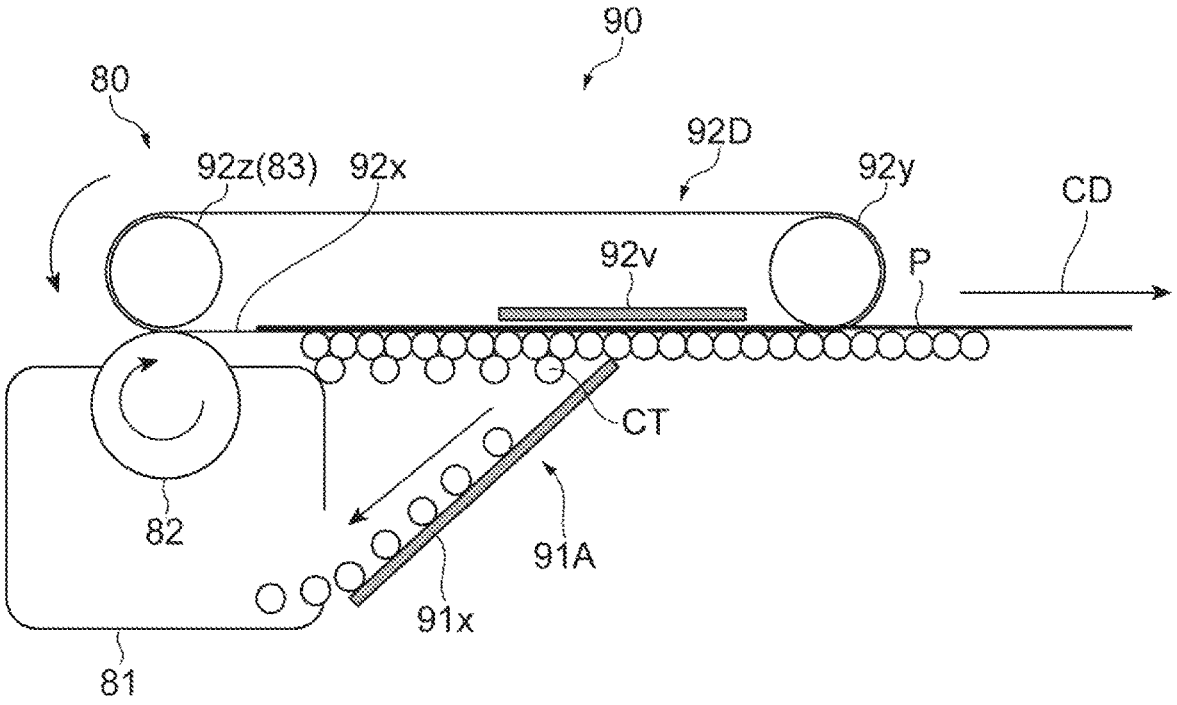
FIG. 17 is a schematic diagram of an example leveling device for gloss toner.

With reference to FIG. 17, in one example, the leveling unit (leveling device) 90 includes the blade member (or blade device) 91A and a guide member (or guide device or guide) 92D. The guide member 92D is a belt-shaped member having a configuration similar to the configuration of the guide member 92C illustrated in FIG. 5, and includes a conveyor belt 92*x* (a belt), the tension rollers 92*y* and 92*z* (belt rotation rollers) rotating the conveyor belt 92*x*, and the flat member 92*v*. The tension roller 92*z* of the guide member 92D also serves as the transfer roller 83 of the clear toner transfer unit 80. For example, the tension roller 92*z* may serve as the transfer roller 83 of the clear toner transfer unit 80 and as the belt rotation roller of the guide member 92D.

Figure 18:
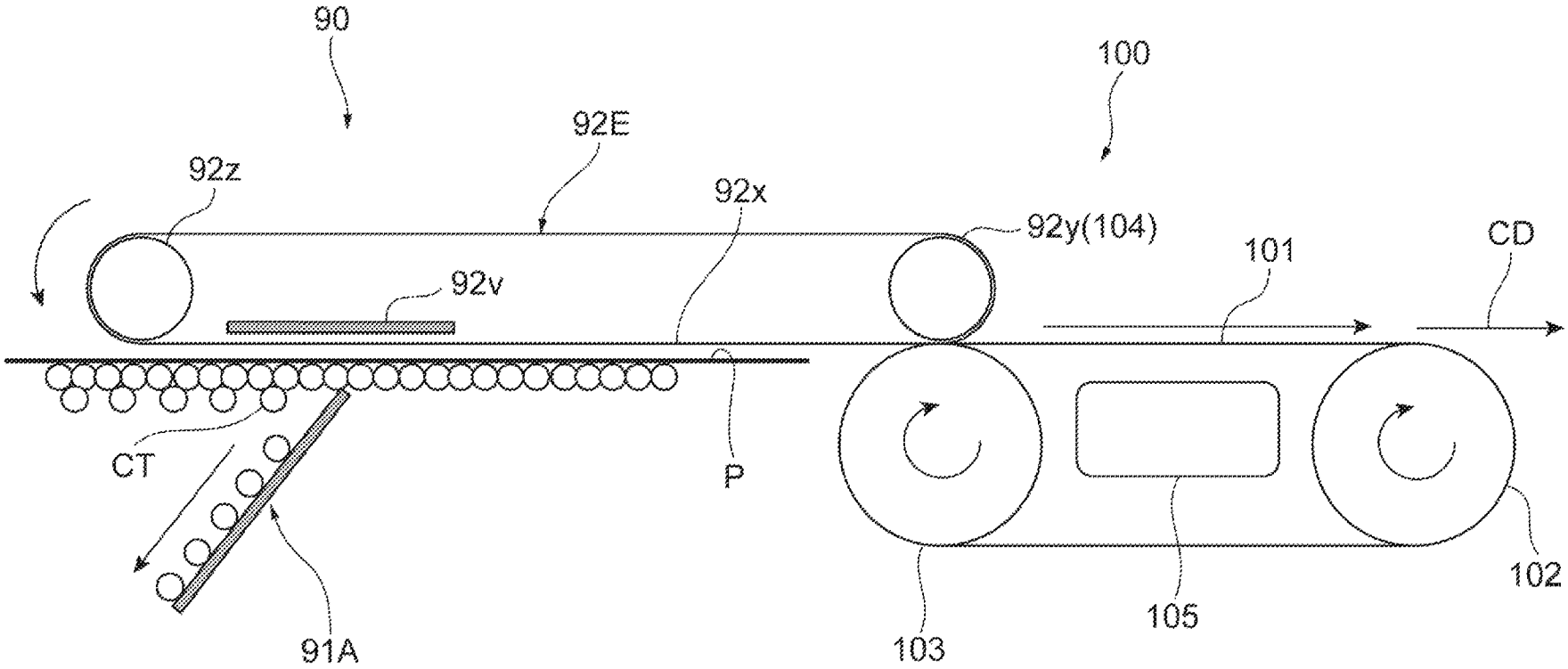
FIG. 18 is a schematic diagram of an example leveling device for gloss toner.

With reference to FIG. 18, the leveling unit 90 includes the blade member (or blade device) 91A and a guide member (or guide device or guide) 92E. The guide member 92E is a belt-shaped member having a configuration similar to the configuration of the guide member 92C illustrated in FIG. 5, and includes a conveyor belt 92*x* (a belt), the tension rollers 92*y* and 92*z* (belt rotation rollers) rotating the conveyor belt 92*x*, and the flat member 92*v*. The tension roller 92*y* of the guide member 92E also serves as the pressing roller 104 relating to the re-melting process of the gloss adding unit 100. The tension roller 92*y* also serves as the pressing roller 104 of the gloss adding unit 100 and the belt rotation roller of the guide member 92E.

An example operation of the example gloss treatment device 70 will be described.

Referring back to FIG. 2, the example gloss treatment device 70 includes the clear toner transfer unit (or device) 80, the leveling unit (or device) 90, and the gloss adding unit (or device) 100. The clear toner transfer unit 80 transfers the clear toner CT to the image surface of the sheet P having an image formed thereon. The leveling unit 90 is disposed on the downstream side of the clear toner transfer unit 80 in the conveying direction CD of the sheet P and levels the layer of the clear toner CT on the image surface. The gloss adding unit 100 is disposed on the downstream side of the leveling unit 90 in the conveying direction CD and performs the re-melting process and the cooling process on the sheet P after the layer of the clear toner CT is leveled.

Figure 19B:
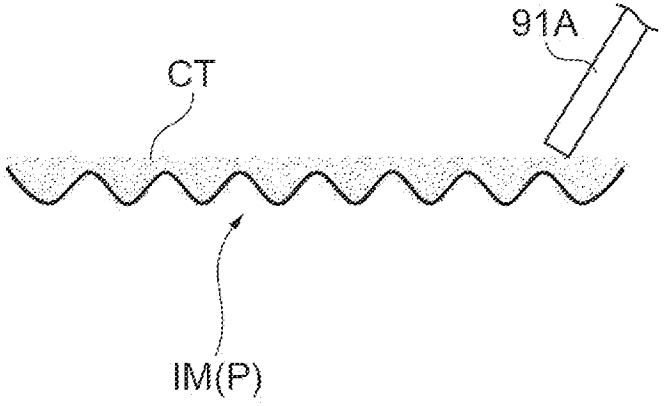
FIG. 19B is a schematic diagram illustrating the layer of clear toner having been leveled.
Figure 19A:
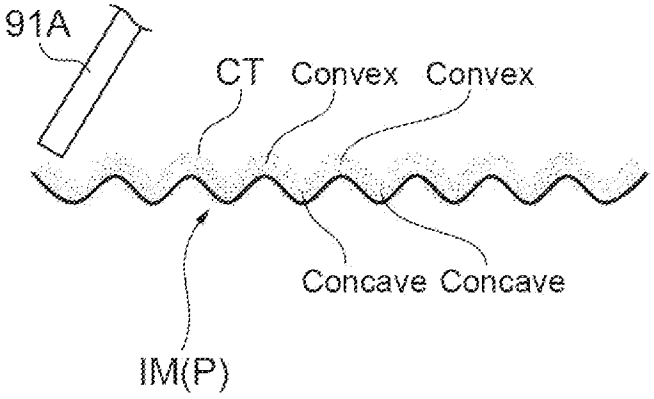
FIG. 19A is a schematic diagram illustrating a layer of clear one to be leveled.
Figure 20A:
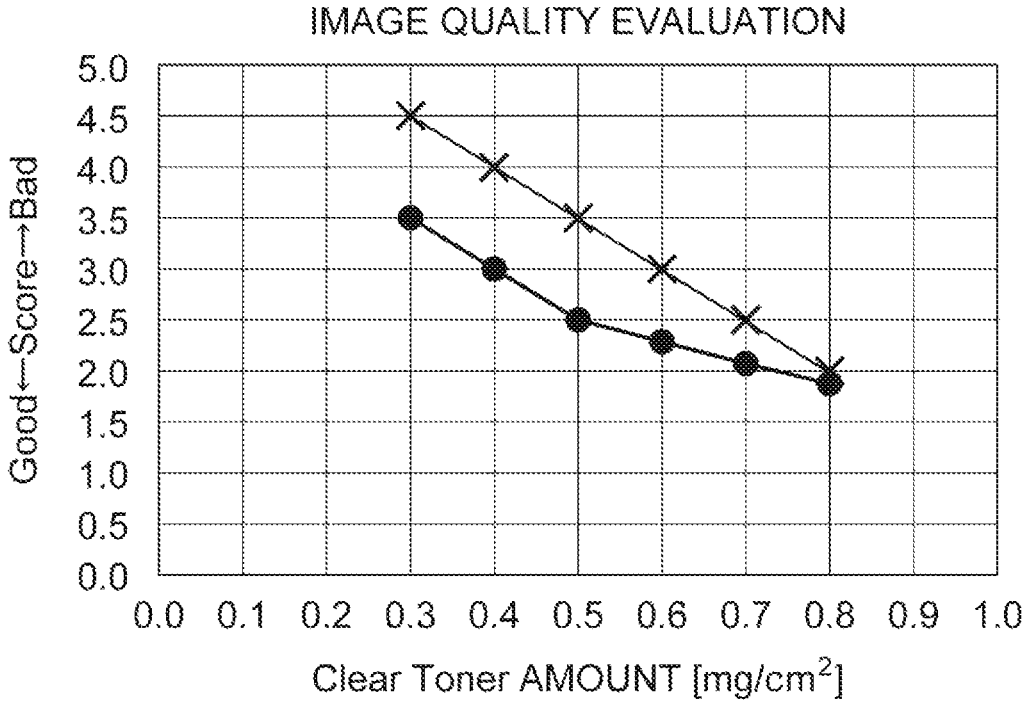
FIG. 20A is a graph of an image quality level in relation to a clear toner amount, in an example leveling device for gloss toner.
Figure 20B:
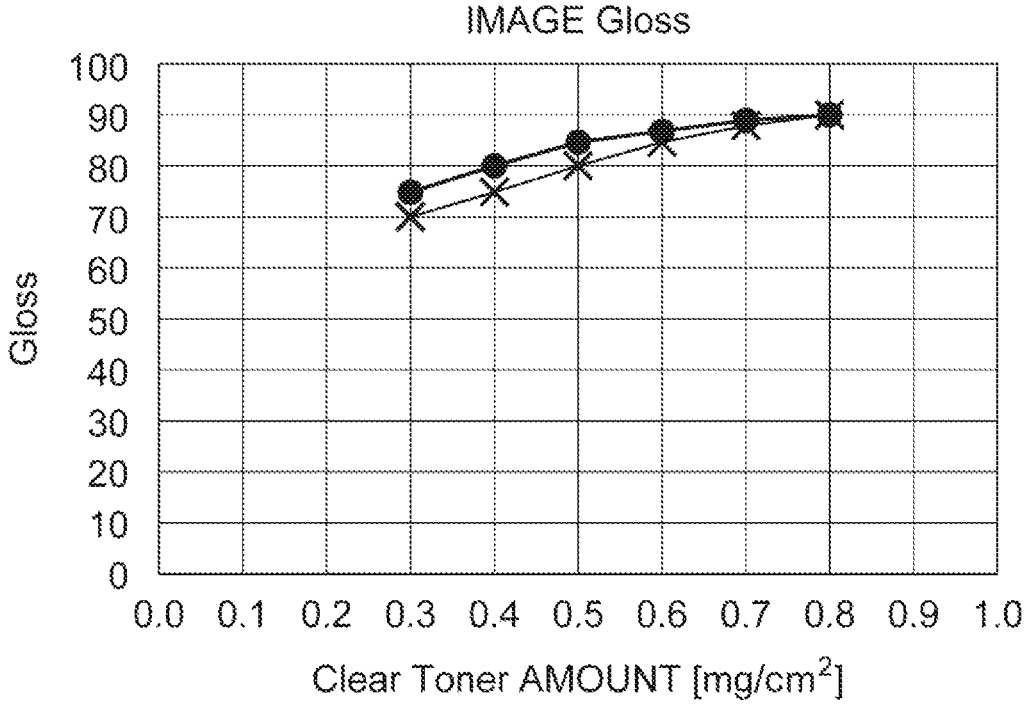
FIG. 20B is a graph of an image gloss in relation to the clear toner amount, in the example leveling device.

The layer of the clear toner CT on the image surface is leveled by the leveling unit 90 before the re-melting process and the cooling process are performed by the gloss adding unit 100. Accordingly, an uneven surface of the clear toner CT which is schematically illustrated in FIG. 19A is leveled to form a smooth surface as schematically illustrated in FIG. 19B after the clear toner CT is transferred. The surface of the clear toner CT is smoothened or leveled, in order to obtain a better image quality and gloss even with a small amount of the clear toner CT. FIG. 20A is a graph showing test results of an image quality score according to the amount of the clear toner CT. FIG. 20B is a graph showing test results of an image gloss score according to the amount of the clear toner CT In FIGS. 20A and 20B, the black circles correspond to results obtained when the clear toner CT has been leveled by the leveling unit 90 and the x-symbol (x) corresponds to results obtained when the clear toner CT has not been leveled. As shown in FIG. 20A, the image quality may be improved by leveling the clear toner CT using the leveling unit 90. As shown in FIG. 20B, the image gloss may be improved by leveling the clear toner CT using the leveling unit 90.

With reference to FIGS. 19A and 19B, the leveling unit 90 may level the layer of the clear toner CT so that the clear toner CT in convex portions is transferred to concave portions of the layer of the clear toner CT, before the gloss adding unit 100 performs the re-melting process and the cooling process. Accordingly, it is possible to appropriately level the layer of the clear toner CT by reducing the unevenness of the layer of the clear toner CT.

The leveling unit 90 may include the blade member (or blade device) 91A (for example, in FIG. 3) that extends toward a surface of the sheet P having an image formed thereon (or toward the conveyance path or route R1) to scrape off a part of the layer of the clear toner CT exceeding a predetermined thickness, in order to better level the layer of the clear toner CT by removing the clear toner CT from thicker portions of the layer of clear toner CT.

With reference to FIG. 3, the blade member 91A may extend toward a surface of the sheet P having an image formed thereon, from the upstream side to the downstream side in the conveying direction CD in order to prevent or inhibit the blade member 91A from disturbing (e.g., or hindering) the smooth conveyance of the sheet P.

With reference to FIG. 6, the blade member 91A may extend toward a surface of the sheet P having an image formed thereon (or toward the conveyance path or route R1), from the downstream side to the upstream side in the conveying direction CD. According to such a configuration, it is possible to increase the magnitude of the frictional force (scraping force) applied by the tip of the blade member 91A to the layer of the clear toner CT.

With reference to FIG. 2, the blade member 91A may include the toner recovery unit (or device) 91*x* which extends toward the developing device 81 of the clear toner CT and returns the scraped clear toner (or excess clear toner) CT into the developing device 81, in order to suppress the consumption amount or waste of the clear toner CT by re-using the excess clear toner CT.

With reference FIG. 10, the blade member 91C may include the scraping roller 91*y* which scrapes off a part of the layer of the clear toner CT in a rotation state and transfers the scraped clear toner CT to the toner recovery unit 91*x*, to prevent an accumulation of the scraped clear toner CT at the tip of the blade member 91C.

With reference to FIG. 13, the rotation speed of the scraping roller 91*y* may be set to a speed at which the clear toner CT can be collected (scraped off) based on the conveying speed of the sheet P. For example, when the rotation speed of the scraping roller 91*y* is the same as the conveying speed of the sheet P, inhibits the scraping roller 91*y* from scraping off the clear toner CT. Accordingly, the rotation speed of the scraping roller 91*y* may be controlled to be different from the conveying speed of the sheet P, to more reliably scrape off the clear toner CT by the scraping roller 91*y*.

The above-described surface of the scraping roller 91*y* may be formed in an unevenness shape, in order to increase a scraping force of the scraping roller 91*y*, as compared with a scraping roller having a smooth surface.

With reference to FIG. 3, the leveling unit 90 may include the guide member 92A that is provided in contact with a surface opposite to a surface of the sheet P having an image formed thereon and guides the conveying of the sheet P, to better scrape off the clear toner CT by the blade member 91A while conveying the sheet P.

With reference to FIG. 7, the blade member 91B may extend to be pressed against the guide member 92A. The blade member 91B may be bent by the conveying force of the sheet P, to prevent or inhibit the conveying of the sheet P from being disturbed or hindered. Since the blade member extends to a position where the tip end contacts the guide member 92A before the blade member is bent, the blade member exerts sufficient force to scrape off the clear toner CT.

With reference to FIGS. 8 and 9, the leveling unit 90 may include the voltage application unit 93 which applies a voltage to at least one of the guide member 92A and the blade member 91A so that the clear toner CT is attracted toward a surface of the sheet P having an image formed thereon, to scrape off the extra (or excess) clear toner CT by the blade member 91A in a state in which the clear toner CT is suitably attracted toward the image surface of the sheet P, in order to better smoothen or level the surface of the clear toner CT.

With reference to FIG. 16, the gap between the blade member 91A and the guide member 92A may be changeable or adjustable based on the thickness of the sheet P, to better smoothen or level the surface of the clear toner CT regardless of the thickness of the sheet P (e.g., for varying thicknesses of the sheet P).

With reference to FIG. 17, the tension roller 92*z* of the guide member 92D may serve as the transfer roller 83 of the clear toner transfer unit 80, to simplify or reduce the size of the configuration.

With reference to FIG. 18, the tension roller 92*y* of the guide member 92E may serve as the pressing roller 104 relating to the re-melting process of the gloss adding unit 100, to simplify or reduce the size of the configuration.

Figure 21:
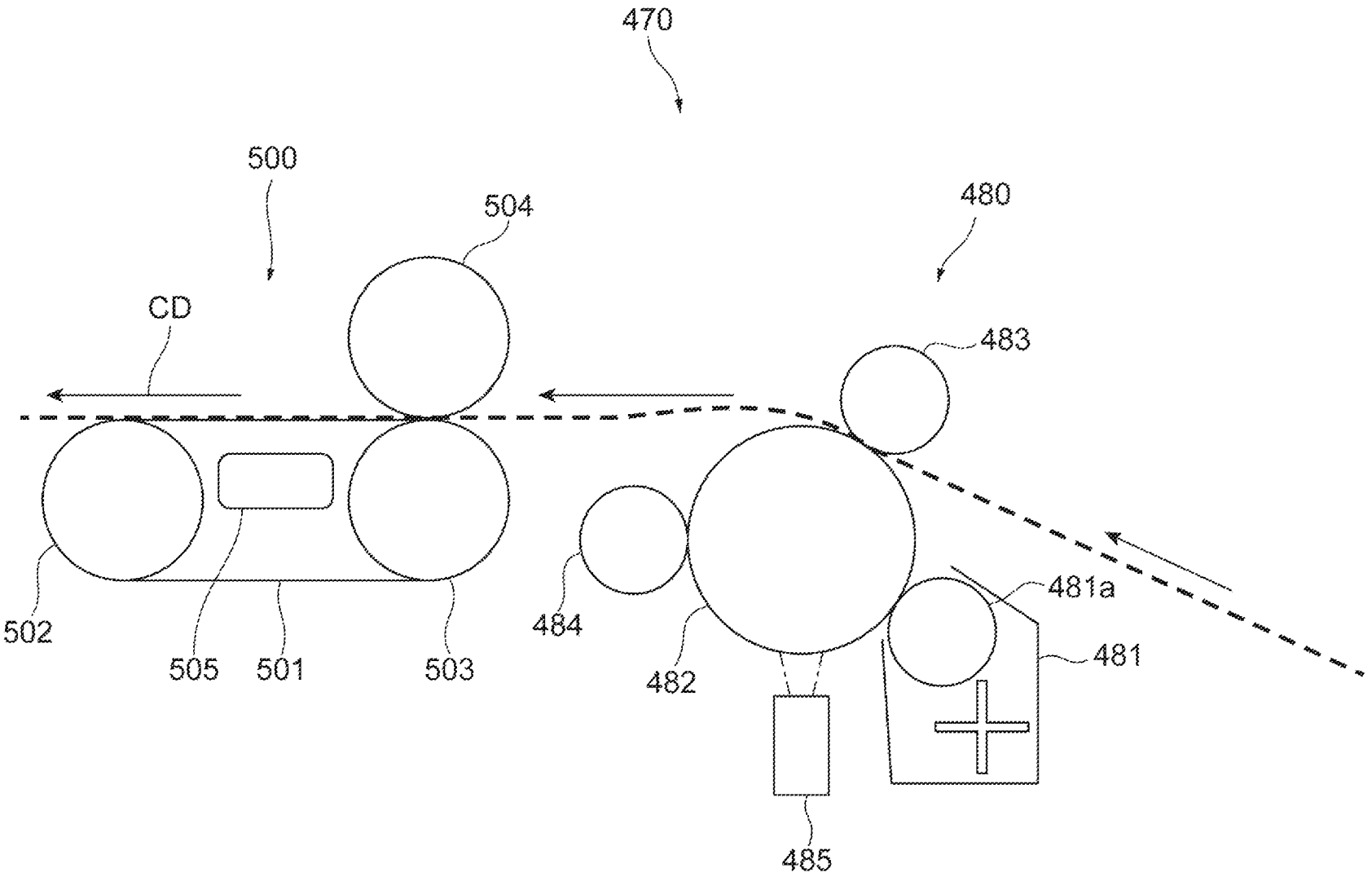
FIG. 21 is a schematic diagram illustrating a portion of an example image forming apparatus.

It is to be understood that not all aspects, advantages and features described herein may necessarily be achieved by, or included in, any one particular example. Indeed, having described and illustrated various examples herein, it should be apparent that other examples may be modified in arrangement and detail. For example, the image forming apparatus may include an example gloss treatment device (or gloss processing device) 470 illustrated in FIG. 21. Additionally, the gloss treatment device 470 may include the leveling unit (or leveling device) 90, according to the examples described herein. As illustrated in FIG. 21, the gloss treatment device 470 includes a clear toner transfer unit (or gloss toner transfer device) 480 and a gloss adding unit (or glossing device) 500.

The clear toner transfer unit 480 transfers the clear toner to the image surface corresponding to a surface of the sheet having an image (e.g., a CMYK image) formed thereon. The clear toner transfer unit 480 includes, for example, a developing device 481, an image carrier 482 (a photosensitive member), a transfer roller 483, a charging roller 484, and an exposure unit 485. In some examples, the clear toner transfer unit 480 may not include the exposure unit 485 for reasons that will be better understood in light of the following description. The developing device 481 includes, for example, a developer carrier 481*a* (a developing sleeve) which carries clear toner on the image carrier 482. The gloss adding unit 500 includes, for example, a conveyor belt 501, a tension roller 502, a heating roller 503 and a pressing roller 504 relating to the re-melting process, and a cooling device 505 relating to the cooling process.

When the clear toner is uniformly transferred to the image surface of the sheet, bubbles may be produced in a gap between the sheet and the clear toner. For example, when the control temperature of the gloss adding unit 500 is high, the above-described gap may expand and form bubbles in the melted clear toner layer. Since the bubbles are clouded, if there are many bubbles, the toner image or portions thereof may appear white or discolored. Accordingly, the transparency and gloss of the image may be decreased which affects the image quality.

Figure 22:
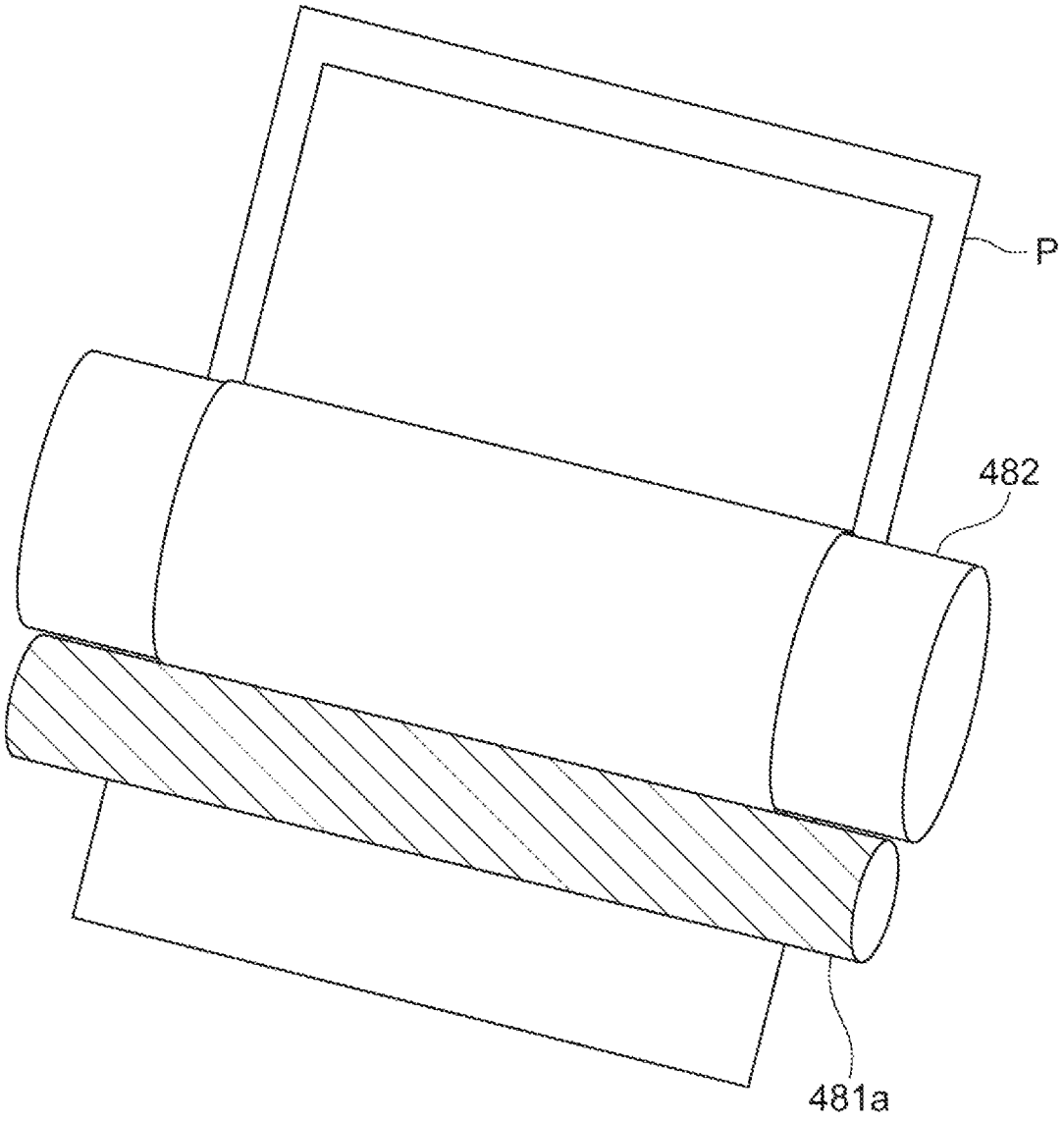
FIG. 22 is a schematic diagram of an example developer carrier having a surface with a pattern.
Figure 23:
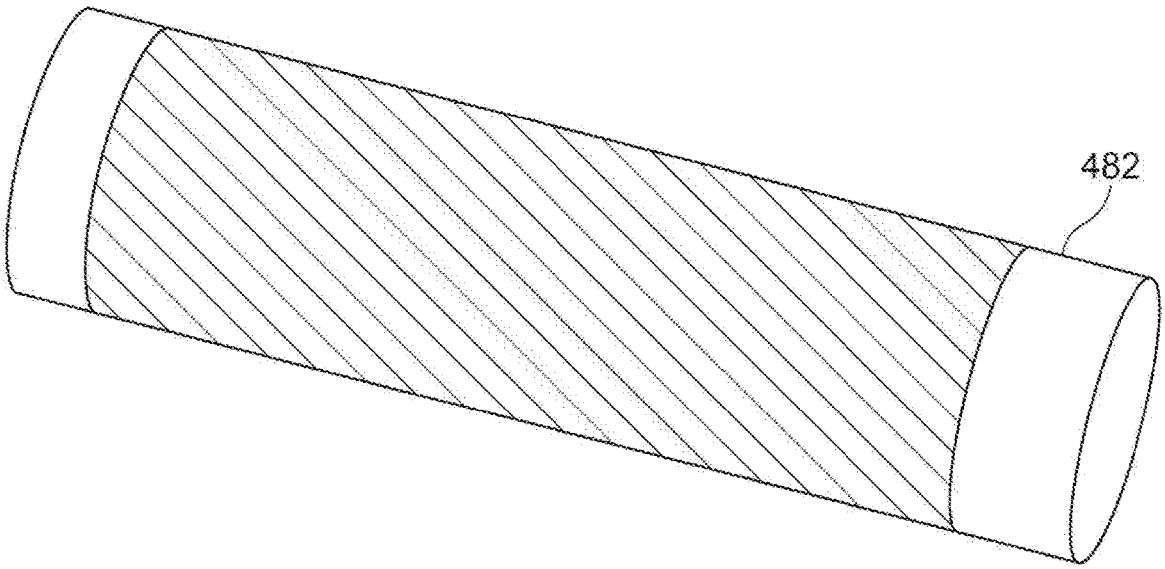
FIG. 23 is a schematic diagram of an example image carrier surface having a surface with a pattern.

In the gloss treatment device 470, a region that releases bubbles in the clear toner layer is formed in order to suppress the amount of bubbles. With reference FIG. 22, for example, the gloss treatment device 470 may have one or more groove(s) formed as a pattern on the surface of the developer carrier 481*a* so that a predetermined pattern is developed. The pattern of the developer carrier may be a pattern which is formed on the surface so that the image carrier surfaces have two or more types of frictional force and a pattern which is formed by two or more types of surfaces so that the image carrier surfaces are magnetic and non-magnetic in addition to the pattern formed according to the height of the groove. Further, the pattern may be formed such that the doctor blades which regulate the height (or thickness) of the developer (the distance from the developer carrier) have alternating (or staggered) heights. In other examples, the gloss treatment device 470 may form a pattern on the surface of the photosensitive layer of the image carrier 482 so as to develop, for example, an image according to a predetermined pattern as illustrated in FIG. 23. The pattern of the surface of the photosensitive member may a pattern in which a portion including the photosensitive layer and a portion not including the photosensitive layer are formed in an alternating manner, on a conductive base layer, a pattern in which a conductive material is formed on the surface of the photosensitive layer, or a pattern in which a conductive portion and a non-conductive portion are formed in an alternating manner on the image carrier surface without the photosensitive layer. The surfaces of the developer carrier and the photosensitive member are patterned to form a toner image width of 100 to 300 μm on the surface of the photosensitive member, to form a gap of 50 to 150 μm between the toner image and the toner image, and such that the width of the toner image is wider than the width between the toner images by the respective patterns thereof. In the example illustrated in FIGS. 22 and 23, a region that releases bubbles in the clear toner layer is obliquely formed with respect to the longitudinal direction of the sheet, to provide a portion having a short bubble releasing distance as compared with, for example, a case in which the region is formed in the longitudinal direction. According to the method illustrated in FIGS. 22 and 23, for example, since there is no need to provide a control unit and a writing unit such as an LED or laser for forming an image as a line pattern of clear toner (writing an electrostatic latent image on a photosensitive member by an exposure unit) as a bubble countermeasure, the gloss treatment device 470 can be simplified in configuration, which may reduce cost (e.g, manufacturing costs).

The invention claimed is:

1. An imaging system comprising:

a toner transfer device to transfer gloss toner to a surface of a medium having an image formed thereon;

a leveling device comprising a blade or a roller and disposed on a downstream side of the toner transfer device in a conveyance direction of the medium along a conveyance path, the blade or the roller to level a layer of the gloss toner on the surface of the medium; and a glossing device disposed on a downstream side of the leveling device, in the conveyance direction, the glossing device to perform a re-melting process and a cooling process on the medium after the layer of the gloss toner is leveled.

2. The imaging system claim 1, wherein the layer of the gloss toner formed on the medium includes a concave portion and a convex portion, the leveling device to level the layer of the gloss toner by transferring a part of the gloss toner from the convex portion to the concave portion in the layer of the gloss toner.

3. The imaging system of claim 1, wherein the leveling device includes the blade that extends toward the conveyance path, the leveling device to scrape off excess toner from the layer of the gloss toner on the surface of the medium in the conveyance path, where the layer exceeds a predetermined thickness.

4. The imaging system of claim 3, wherein the blade extends toward the conveyance path from an upstream side to a downstream side in the conveyance direction.

5. The imaging system of claim 3, wherein the blade extends toward the conveyance path from a downstream side to an upstream side in the conveyance direction.

6. The imaging system of claim 3, wherein the blade is inclined with respect to the conveyance path of the medium.

7. The imaging system of claim 3, wherein the blade includes a toner recovery device extending toward a developing device for the gloss toner, to return the excess toner to the developing device.

8. The imaging system of claim 7, wherein the blade includes a rotation portion that is rotatable to scrape off the excess toner from the layer of the gloss toner and to transfer the excess toner to the toner recovery device.

9. The imaging system of claim 8, the rotation portion to rotate at a speed based on a conveyance speed of the medium along the conveyance path.

10. The imaging system of claim 8, wherein the rotation portion has an uneven surface.

11. The imaging system of claim 3, wherein the leveling device further includes a guide device to contact a surface of the medium, opposite to the surface having the image formed thereon, the guide device to guide the medium along the conveyance path.

12. The imaging system of claim 11, wherein the blade extends to press against the guide device, wherein the blade is flexible to bend in response to a force of conveyance of the medium.

13. The imaging system of claim 11, wherein the leveling device further includes an application device to apply a voltage to the guide device so that the gloss toner is attracted toward the surface of the medium having the image formed thereon.

14. The imaging system of claim 11, wherein a gap between the blade and the guide device is adjustable based on a thickness of the medium.

15. The imaging system of claim 11, wherein the guide device includes a belt to convey the medium along the conveyance path, and a belt roller to rotate the belt, and wherein the belt roller serves as a transfer roller of the toner transfer device.

16. The imaging system of claim 11, wherein the leveling device further includes an application device to apply a voltage to the blade so that the gloss toner is attracted toward the surface of the medium having the image formed thereon.

17. A gloss treatment device comprising:

a toner transfer device to transfer gloss toner to a surface of a medium;

a leveling device comprising a blade or a roller to level a layer of the gloss toner formed on the medium; and a glossing device to perform a re-melting process and a cooling process on the medium after the layer of the gloss toner has been leveled.

18. The gloss treatment device of claim 17, wherein the leveling device comprises the blade that is inclined with respect to a conveyance path of the medium.

19. The gloss treatment device of claim 18, wherein the blade is flexible and is to bend responsive to a force applied by the medium traveling along the conveyance path.

20. The gloss treatment device of claim 17, wherein the leveling device comprises the roller to scrape off a portion of the layer of the gloss toner.

* * * * *